US005731531A

United States Patent [19]

Kun

[11] Patent Number: 5,731,531

[45] Date of Patent: Mar. 24, 1998

[54] SHOULDER REST FOR VIOLIN OR LIKE INSTRUMENT

[76] Inventor: Michael Kun, 123 Maple Branch Path, Toronto, Ontario, Canada, M9P 3R9

[21] Appl. No.: 785,971

[22] Filed: Jan. 22, 1997

[51] Int. Cl.[6] ..... G10D 1/02

[52] U.S. Cl. ..... 84/280; 84/278; 84/279

[58] Field of Search ..... 84/278, 279, 280

[56] References Cited

U.S. PATENT DOCUMENTS

| | | | |
|---|---|---|---|
| 3,631,754 | 1/1972 | Kun | 84/280 |
| 5,270,474 | 12/1993 | Kun | 84/280 |
| 5,419,226 | 5/1995 | Kun | 84/280 |
| 5,567,893 | 10/1996 | Kun | 84/280 |

*Primary Examiner*—Cassandra C. Spyrou
*Assistant Examiner*—Shih-yung Hsieh
*Attorney, Agent, or Firm*—Jones, Tullar & Cooper, P.C.

[57] ABSTRACT

A shoulder rest for an instrument such as a violin or viola, comprising an elongated support suitable for resting on a user's shoulder, and an attachment device adjacent each end of the support for attachment to the instrument with the support spaced away from the back of the instrument. The attachment devices each include a base part upstanding from the support, and a pedestal mounted on the base part and carrying a clamping member terminating in recesses engageable with a back portion of the instrument. The invention provides a single shaft connecting the base part and the pedestal which passes through a bore in the pedestal which bore is elongated in cross-section and allows the pedestal to both tilt relative to the base part and to fold down onto the support when the shoulder rest is detached from the instrument, so as to reduce the height for storage.

7 Claims, 2 Drawing Sheets

SHOULDER REST FOR VIOLIN OR LIKE INSTRUMENT

BACKGROUND OF THE INVENTION

1. Field of the Invention

The present invention relates to shoulder rests for use with violins, violas, or like instruments.

2. Prior Art

Shoulder rests for violins and like instruments are known which provide a padded support spaced from the back of the instrument, with the spacing being adjustable. Such rests allow the user easily to position the instrument at the most comfortable playing position, irrespective of the build of the user. Prior patents showing such rests are as follows:

U.S. Pat. No. 3,631,754, issued Jan. 4, 1972 to Joseph Kun,

U.S. Pat. No. 5,270,474, issued Dec. 14, 1993 ,, ,, ,, ,

U.S. Pat. No. 5,419,226, issued May 30, 1995 ,, ,, ,, ;

and my own U.S. Pat. No. 5,567,893, issued Oct. 22, 1996.

These prior patents show shoulder rests comprising an elongated support suitable for resting on a user's shoulder, and pedestals upstanding from each end of the support and carrying clamping members for clamping to a back portion of the instrument. Each clamping member is associated with adjustment means for varying the spacing between the instrument back and the support, and for varying the longitudinal inclination of the support relative to the instrument back. Also, in each case the pedestals include pivot means allowing them to be tiltable sideways for varying the side or lateral inclination between the support and the instrument back. In the '754 patent, the latter means include pivots connecting the pedestals to a base part fixed to the support. In the '474 patent pivot means are also provided between the pedestals and base parts, and are associated with stop means to limit the angle of tilting movement. In my '893 patent, a pedestal is connected to a base part by a bearing generally aligned with the support, and allowing similar tilting, and spring means are provided between the pedestal and the base part for urging the pedestal to a central position.

In the '226 patent, the pedestals are not only tiltable sideways as in the prior patents, but are also made foldable about transverse axes so that when the shoulder rest is removed from the instrument the pedestals can be folded inwards to bring the clamping members close to the elongated support. This reduces the height of the shoulder rest so that it can be fitted, along with the instrument, into a typical instrument case.

SUMMARY OF THE INVENTION

The present invention provides a shoulder rest which allows the same kind of adjustability as is provided in the patented constructions described above, and, like the '226 patent, also has a mechanism allowing folding so that the rest can fit into an instrument case; however this mechanism is simpler and has fewer parts than is required in the design shown in the '226 patent.

In accordance with the present invention, a shoulder rest for violins or like instruments is similar to those of the above-mentioned patents in having an elongated support suitable for resting on a user's shoulder, and attachment means adjacent each end of the support for attaching to the instrument with the support spaced away from the back of the instrument. As in the '226 patent, at least one of the attachment means includes a base part having flanges or lugs with axially aligned bores extending transversely of the support, a pedestal mounted on the base part and carrying a clamping member engageable with a back portion of the instrument, the pedestal having a transverse bore, and shaft means extending through the bores of the base part and pedestal and providing a bearing which connects the pedestal to the base part and allows the pedestal to be folded through about a right angle from an upright position in which the clamping member can engage the instrument to a folded position in which the clamping member lies close to the support.

The arrangement differs however from that of the '226 patent in that the bores of the lugs or flanges, and of the pedestal, include at least one bore portion which is elongated in cross-section in such manner that when the pedestal is in the upright position it can be tilted about an axis which is perpendicular to the shaft means and which extends along the support, with the shaft means moving laterally within the elongated bore portion.

This arrangement is simpler than that of the '226 patent, since a single shaft means provides both the tiltable adjustment about the axis which extends along the support, and the folding movement about the transverse axis. This allows the pedestal to be made in a single piece, rather than the two pieces shown in the '226 patent.

The aligned bores in the base part are preferably of circular cross-section to closely surround the shaft means, while the bore in the pedestal has two portions of elongated cross-section. Specifically, the latter bore has a circular central portion which closely fits the shaft means, and has portions diverging from the central section and leading to elongated apertures in the sides of the pedestal, these diverging portions allowing tilting of the pedestal while the shaft means remains stationary.

The base part may have a recess lying between two upstanding lugs, the two lugs having circular co-axially aligned bores which extend transversely to the support, while the pedestal has a rounded portion lying within the recess.

Preferably, the base part is longitudinally adjustable relative to the support. Preferably also, both of the attachment means are identical insofar as they both comprise a base part, a pedestal and a clamping member, and shaft means or a pivot pin which is movable in the bore of the pedestal, as described.

BRIEF DESCRIPTION OF THE DRAWINGS

A preferred embodiment of the invention will now be described by way of example with reference to the accompanying drawings, in which.

DETAILED DESCRIPTION

Figure 1:
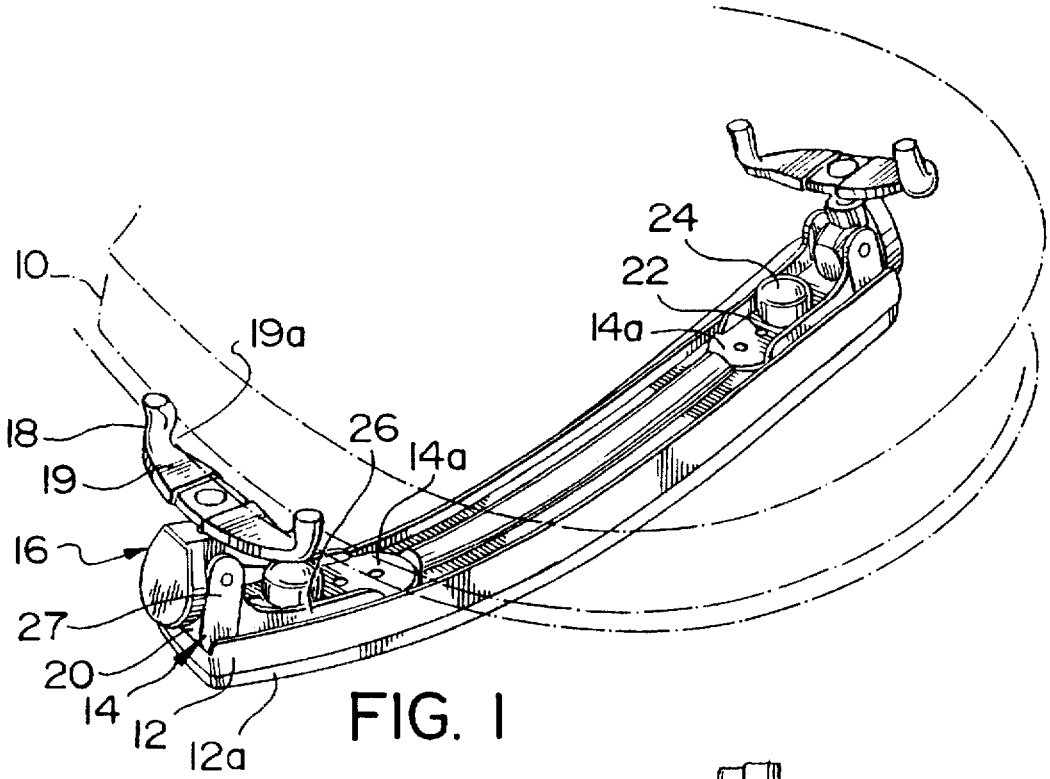
FIG.1 is a perspective view of the shoulder rest as attached to a violin which is indicated in broken lines.
Figure 2:
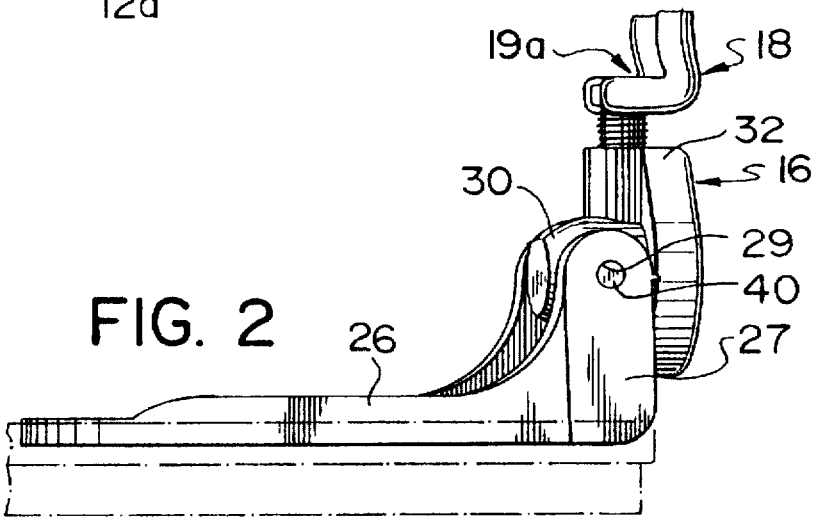
FIG. 2 is a side view of attachment means at one end of the rest in position for holding the violin or other instrument.

FIG.1 shows a general view of the shoulder rest as attached to a violin indicated at 10. Basically, the rest includes an elongated support 12, having at each end attachment means comprising a base part 14 on which is mounted a pedestal 16, and a clamping member 18 carried by the pedestal and having arms 19 with spaced apart recesses 19*a* which engage the slightly protruding edges of the back of the violin.

The elongated support 12 is formed of material having some flexibility to allow a user to bend it into the best possible shape to conform with the user's shoulder. The lower side of the support is padded with foam rubber 12*a*.

Figure 4:
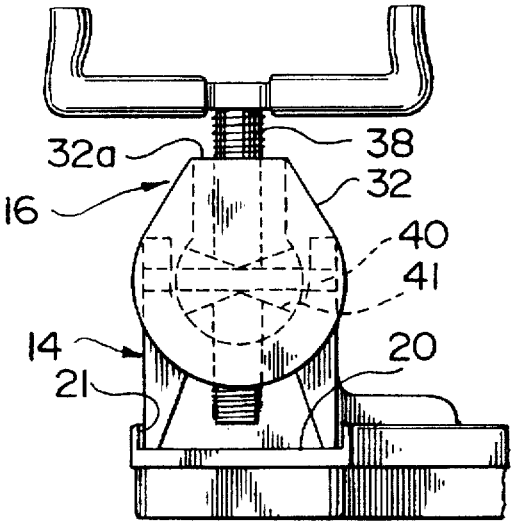
FIG. 4 is a view on one end of the shoulder rest, showing the pedestal in a first position.

As shown in FIGS. 1 and 4, at each end of the support a recess 20 is provided having parallel sidewalls 21 which receive interfitting edges of the base part 14. These sidewalls thus provide parallel guide means in which the base part is slidable, these being roughly aligned with the adjacent end portion of the support.

Figure 6:
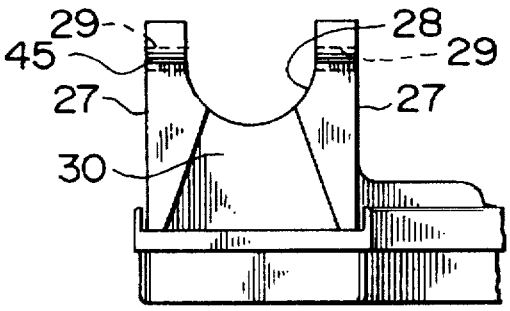
FIG. 6 is an end view of the base with the pedestal removed.
Figure 7:
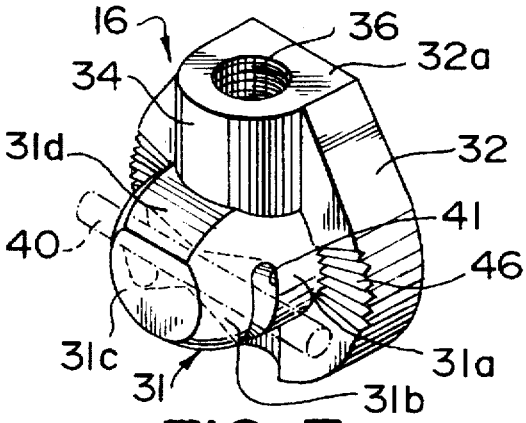
FIG. 7 is a perspective view of the pedestal.

The base part 14 is formed as a plastic molding, and has a flat lower part 14*a* engaging the upper surface of the support 12. This lower part has spaced bores 22 one of which can receive a threaded stud (not shown) projecting up from the support, the base part being secured on the stud by a manually rotatable nut 24 threaded onto the top end of the stud; the several bores 22 give suitable adjustability to different widths of instruments. At each of its sides the base part has an upstanding flange 26, and at the outer end of the base part these are extended to form upstanding lugs 27, between which is a recess of semi-cylindrical form, indicated at 28 in FIG. 6, the axis of which extends at a small angle, say less than 20°, to the main axis of the rest. The pair of lugs has co-axially aligned circular bores 29 (also indicated in FIG. 6) the common axis of which is parallel to the plane of the support, perpendicular to the axis of the cylindrical recess 28, and transverse to the support. The outer end surfaces of the base parts each have a recess 30, indicated in FIG. 6, which communicates with recess 28.

Figure 5:
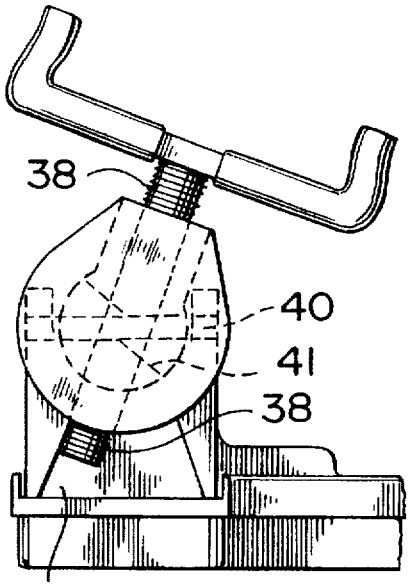
FIG. 5 is a view similar to FIG. 4 with the pedestal tilted.

FIGS. 2–7 show details of the pedestal 16 which is mounted in each base part. This is molded of plastics material, and has a rounded boss 31 connected to an enlarged, partly circular flange 32, the shape of which is best seen in FIG. 4. A portion of the boss closest to the flange 32 has a part-cylindrical surface 31*a* which fits within the recess 28, and this surface merges with a convex surface 31*b* leading to a flat end surface 31*c*. The outer portion of the top of the boss has a flattened downwardly sloping surface 31*d*. The flange portion 32 has a flat upper surface portion 32*a*, and this includes a semi-circular area projecting over the boss and connected to the upper inner portion of the boss by a bulged support portion 34. The radial center of the upper surface portion 32*a* provides the upper end of a threaded bore 36 which receives the threaded post 38 of the clamping member 18; this threaded connection provides for adjustment of the spacing between the support 12 and the instrument back, as well as the longitudinal inclination of the support. The lower end of post 38 may protrude below the boss 31 into recess 30 as indicated in FIGS. 4 and 5, and is free to move within recess 30 as the pedestal is tilted. The clamping member 18 may be similar to that of U.S. Pat. No. 5,270,474 referred to above.

The lugs 27 and the pedestal are connected by shaft means in the form of a pivot pin 40 which passes through a transverse bore 41 in the boss 31 of the pedestal. This allows the pedestal to pivot from the upright position shown in FIGS. 1, 2, 4 and 5, in which it can engage the back of an instrument, to the folded position shown in FIG. 3 in which the height of the shoulder rest is reduced to allow it to fit, along with the instrument, into an instrument case. In accordance with this invention, the bore 41 in the pedestal boss 31 has a central portion which is circular in cross-section and closely fits the pivot pin 40, and, as indicated in FIGS. 4 and 5, has diverging side portions of elongated cross section which meet the side surfaces of the boss at elongated apertures seen in FIG. 7, these diverging side portions being parallel to the flange 32 and thus being vertical when the pedestal is upright. The pivot pin 40 supports the pedestal on the bore 41 for transverse, relative tilting movement about the pivot 40 to allow the pedestal to be tilted from the position of FIG. 4 to the position of FIG. 5 and also to be tilted in the opposite direction; in practice about 20° of tilt from either side of the vertical is possible.

To control the tilting, detent means are provided cooperating between the pedestal and the base part. Specifically, the outer end faces of the lugs 27, which are co-planar, are provided with a pair of aligned radial ribs 45, shown in FIG. 6, and these cooperate with series of radial grooves 46 on the inner surface of the flange portion 32 of the pedestal, seen in FIG.7, these detent means being designed to ensure that the tilting action has to be deliberate and does not occur by accident.

Figure 3:
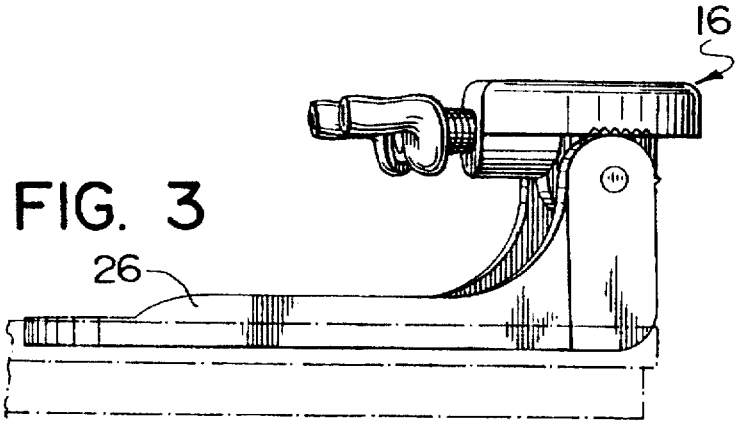
FIG 3 is a view similar to FIG. 2, with the pedestal in the folded position.

In use, the clamping arms 19 are adjusted to the required height by rotation to adjust the posts 38, and the base parts 14 are adjusted longitudinally in the recesses 20 to suit the dimensions of the instrument, and are fixed by nuts 24, with the clamping arms in place on the instrument. The shoulder rest thus attached provides reasonably stable holding of the instrument, while the detent means 45, 46, still allows adjustability of the tilt angle. When detached from the instrument, the pedestals can be folded as indicated in FIG. 3.

I claim:

1. A shoulder rest for an instrument such as a violin or viola, comprising an elongated support suitable for resting on a user's shoulder, and attachment means adjacent each end of the support for attachment to the instrument with the support spaced away from the back of the instrument, wherein at least one of said attachment means comprises:

a base part upstanding from said support and having spaced lugs with axially aligned bores extending transversely of the support, a pedestal mounted on said base part and carrying a clamping member having means engageable with a back portion of said instrument, said pedestal having a transverse bore, shaft means extending through said bores of the lugs and of the pedestal and providing a bearing which connects the pedestal to the base part and allows the pedestal to be pivoted through about a right angle from an upright position in which the clamping means can engage the instrument to a folded position in which the clamping means lie close to the support wherein said bores in said pedestal and said lungs include at least one bore portion which is elongated in cross-section in such manner that when the pedestal is in the upright position the pedestal can be tilted about an axis perpendicular to said shaft means and extending along the support while said shaft means has movement relative to and transversely within said elongated bore portion.

2. The shoulder rest according to claim 1, wherein the bores in said base part are circular while the bore in the pedestal is elongated in cross-section, said latter bore having a circular central portion which closely fits the shaft means and having side portions diverging from said central portion and which lead to elongated apertures in the sides of the pedestal, said side portions allowing tilting of the pedestal while the shaft means remains stationary.

3. The shoulder rest according to claim 1, wherein detent means are provided acting between the base part and the pedestal and which control the tilting of the pedestal.

4. The shoulder rest according to claim 1, wherein both of said attachment means are identical insofar as they each comprise a base part, a pedestal carrying a clamping member, and an elongated bore with shaft means extending therethrough.

5. A shoulder rest for an instrument such as a violin or viola, comprising an elongated support suitable for resting on a user's shoulder, and attachment means adjacent each end of the support for attachment to the instrument with the support spaced away from the back of the instrument, wherein at least one of said attachment means comprises:

a base part upstanding from the support, said base part having a recess lying between two upstanding lugs, the two lugs having circular bores which are coaxially aligned and extend transversely to the support;

a pedestal having a rounded portion fitted within said recess of said base part and carrying a clamping member terminating in means engageable with a back portion of said instrument, said rounded portion having a transverse bore, a pivot pin extending through said aligned apertures of the lugs and through the transverse bore of the pedestal, and wherein the transverse bore of the pedestal has a narrow central portion closely fitting the pivot pin and has diverging side portions which are vertically elongated when the pedestal is upright, thus allowing tilting action of the pedestal, when upright, about an axis which is longitudinal relative to the support, with the bore moving transversely about said pivot pin.

6. The shoulder rest according to claim 5, wherein said rounded portion of the pedestal forms a boss connected to a flange portion, said flange portion and the base part having interengaging detents which control the tilting of the pedestal.

7. The shoulder rest according to claim 6, wherein the detents include rib means and cooperating grooves in a radial surface of the base part and in a radial surface of the flange portion.

* * * * *

UNITED STATES PATENT AND TRADEMARK OFFICE

CERTIFICATE OF CORRECTION

PATENT NO. : 5,731,531
DATED : March 24, 1998
INVENTOR(S) : Michael Kun, et al

It is certified that error appears in the above-identified patent and that said Letters Patent is hereby corrected as shown below:

On the title page: Item [19] second line, change "Kun" to --Kun et al.__

Item [76] to read:

--Inventors: Michael Kun, Toronto, and Jaroslav Marius Hvezda, Ompah, both of Ontario, Canada.--

Signed and Sealed this

Fourteenth Day of September, 1999

*Attest:*

Q. TODD DICKINSON

*Attesting Officer*

*Acting Commissioner of Patents and Trademarks*